US007093321B2

(12) United States Patent
Burbrink et al.

(10) Patent No.: US 7,093,321 B2
(45) Date of Patent: Aug. 22, 2006

(54) LOCKABLE HINGE

(75) Inventors: Philip W. Burbrink, Columbus, IN (US); Trevor S. Brown, Salem, IN (US)

(73) Assignee: Cosco Management, Inc., Wilmington, DE (US)

( * ) Notice: Subject to any disclaimer, the term of this patent is extended or adjusted under 35 U.S.C. 154(b) by 87 days.

(21) Appl. No.: 10/862,606

(22) Filed: Jun. 7, 2004

(65) Prior Publication Data

US 2005/0268434 A1 Dec. 8, 2005

(51) Int. Cl.
*E05D 11/10* (2006.01)

(52) U.S. Cl. ..... 16/324; 182/163

(58) Field of Classification Search ..... 16/326–329, 16/324, 231, 233; 182/163, 22–26; 403/96–98, 403/92, 93, 329, 330, 102; D25/64, 65
See application file for complete search history.

(56) References Cited

U.S. PATENT DOCUMENTS

| | | | | |
|---|---|---|---|---|
| 3,048,883 | A | 8/1962 | Rizzuto | |
| 3,731,342 | A | 5/1973 | Cousin | |
| 3,811,151 | A | 5/1974 | Kuemmerlin | |
| 3,879,146 | A | 4/1975 | Mayer | |
| 4,152,810 | A | 5/1979 | Martinez | |
| 4,216,844 | A | 8/1980 | Klafs | |
| 4,403,373 | A | 9/1983 | Kuemmerlin | |
| 4,407,045 | A | 10/1983 | Boothe | |
| 4,540,306 | A | 9/1985 | Wang | |
| 4,566,150 | A | 1/1986 | Boothe | |
| 4,666,327 | A | 5/1987 | Su | |
| 4,666,328 | A | 5/1987 | Ryu | |
| 4,697,305 | A * | 10/1987 | Boothe | 16/329 |
| 4,925,329 | A * | 5/1990 | Chuang | 403/93 |
| 5,590,931 | A * | 1/1997 | Fourrey et al. | 297/366 |
| 6,112,370 | A * | 9/2000 | Blanchard et al. | 16/325 |
| 6,343,406 | B1 * | 2/2002 | Yeh | 16/328 |
| 6,711,780 | B1 * | 3/2004 | Lee | 16/326 |
| 6,910,738 | B1 * | 6/2005 | Bonk | 297/367 |
| 2004/0226773 | A1 * | 11/2004 | Beaver et al. | 182/163 |

FOREIGN PATENT DOCUMENTS

| | | | |
|---|---|---|---|
| DE | 0359970 | A1 * | 3/1990 |
| EP | 1 182 322 | A | 2/2002 |
| FR | 2 392 268 | A | 12/1978 |

* cited by examiner

*Primary Examiner*—Robert J. Sandy
*Assistant Examiner*—Andre' L. Jackson
(74) *Attorney, Agent, or Firm*—Barnes & Thornburg LLP

(57) ABSTRACT

A lockable hinge includes a first and second hinge member, a lock, and an actuator. The lockable hinge is coupled to a pair of ladder-leg sections and is arranged to allow the ladder-leg sections to move among closed, trestle-ladder, and straight-ladder positions. The lock is used to lock the hinge members to cause the ladder-leg sections to lock in the closed, trestle-ladder and straight-ladder positions.

19 Claims, 8 Drawing Sheets

LOCKABLE HINGE

BACKGROUND

The present disclosure relates to hinges and particularly to lockable hinges. More particularly, the present disclosure relates to lockable hinges for center-fold or multi-fold ladders.

Hinges are used in a variety of applications. Lockable hinges are often used on ladders to allow one section of the ladder legs to move relative to another section and to lock the ladder-leg sections in predetermined positions.

SUMMARY

According to the present disclosure, a lockable hinge includes a lock, an actuator, and a pair of hinge members adapted to be coupled to a pair of ladder-leg sections for movement of the ladder-leg sections among closed, trestle-ladder, and straight-ladder positions. The lockable hinge is used to lock the hinge members to cause the ladder-leg sections to lock in the closed, trestle-ladder, and straight-ladder positions.

Illustratively, a pair of lockable hinges are coupled to a pair of ladder-leg sections. The lock, actuator, and first and second hinge members share a common pivot axis to allow pivoting movement of the ladder-leg sections. The lock includes a pair of tabs that are biased to press outwardly from the common axis against an annular flange portion of the first hinge member. The annular flange portion includes a plurality of tab-receiving spaces associated with the closed, trestle-ladder, and straight-ladder positions. Upon movement of the tabs into the lock-receiving spaces, the lockable hinge locks and blocks pivotable movement of the first and second hinge members about the common axis.

The actuator includes a rotary knob and a pair of connector posts coupled to the mounting plate. To unlock the hinge, an input force is applied to the knob to cause the tabs to move toward the common axis and away from the lock-receiving spaces. Upon retraction of the tabs from the lock-receiving spaces, the hinge members and the ladder-leg sections are able to pivot relative to one another to any of the other predetermined ladder positions.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 6 is an enlarged side elevation view of the lockable ladder hinge of the ladder of FIG. 1, with portions broken away, showing the rotatable actuator aligned in its upright starting position as shown in FIGS. 1 and 5;

FIG. 7 is a perspective view, with portions broken away, of the ladder of FIG. 1 after the actuators have been rotated to a second position so that the ladder-leg sections can be moved to the trestle-ladder position to establish the included angle of about 40° between the ladder-leg sections;

FIG. 8 is a side elevation view of the lockable ladder hinge of the ladder of FIG. 1, with portions broken away, showing the unlocked hinge in motion to the trestle-ladder position to establish the included angle of about 40° between the ladder-leg sections;

FIG. 9 is a side elevation view of the ladder of FIG. 1, with portions broken away, showing the hinge lock in motion to the trestle-ladder position and a pair of tabs biased to expand radially outwardly from a common axis so that the tabs are received by the lock-receiving spaces formed in the cylindrical inner housing of the first hinge member;

FIG. 10 is an enlarged side elevation view of the lockable ladder hinge of the ladder of FIG. 2, with portions broken away, showing the hinge locked in the trestle-ladder (40°) position;

FIG. 11 is a perspective view, with portions broken away, of the ladder of FIG. 2 showing the actuators rotated to the second position to unlock the lockable hinges so that the ladder can be moved to the straight-ladder (180°) position;

FIG. 12 is a side elevation view of the lockable ladder hinge of the ladder of FIG. 2, with portions broken away, showing the unlocked hinge moving from the trestle-ladder (40°) position to the straight-ladder (180°) position;

FIG. 13 is a side elevation view of the ladder of FIG. 3, with portions broken away, showing the lock in motion to the straight-ladder (180°) position, and the tabs biased to expand radially outwardly from the common axis so that each tab is received by the lock-receiving spaces formed in the cylindrical inner housing of the first hinge member.

DETAILED DESCRIPTION

Figure 2:
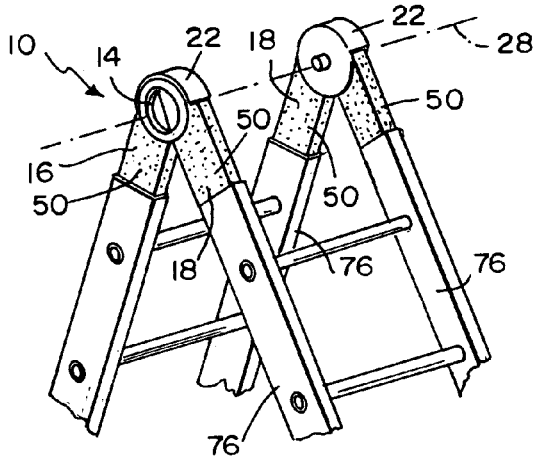
FIG. 2 is a perspective view of the ladder of FIG. 1, with portions broken away, showing the ladder-leg sections unfolded to a trestle-ladder position and the lockable ladder hinge locked to establish an included angle of about 40° between the ladder-leg sections.
Figure 1:
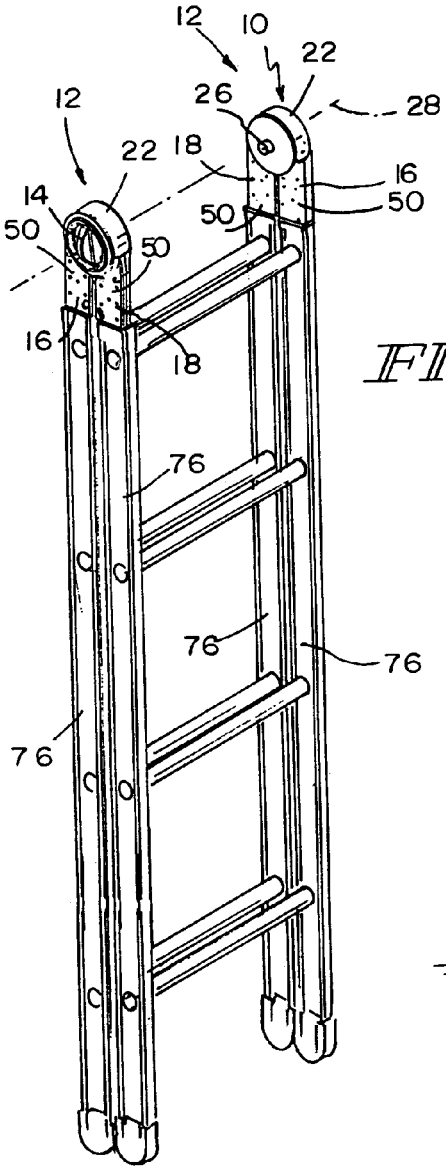
FIG. 1 is a perspective view showing a two-section ladder including a lockable ladder hinge that is positioned in a closed-ladder position and the hinge locked to establish an included angle of 0° between first and second sections of the ladder.
Figure 3:
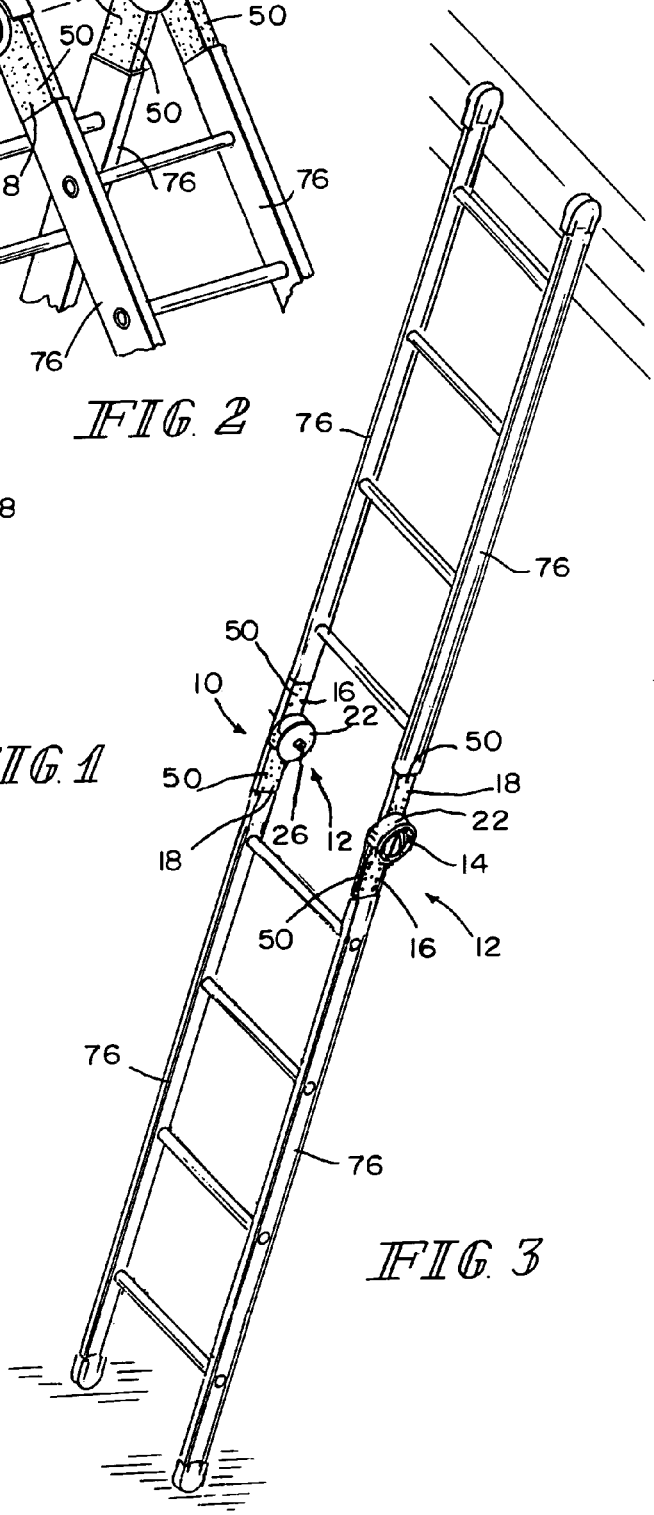
FIG. 3 is a perspective view of the ladder of FIG. 1 showing the ladder in a straight-ladder position and the lockable hinge locked to establish an angle of about 180° between the ladder-leg sections.

A lockable hinge 10 includes a lock 12, an actuator 14, and first and second hinge members 16, 18 adapted to be coupled to a pair of ladder-leg sections 76, as shown, for example in FIGS. 1–3. In a preferred embodiment, a user is able to lock hinge members 16, 18 to cause ladder-leg sections 76 to lock in a closed position to establish an included angle of about 0° between ladder-leg sections, a trestle-ladder position to establish an included angle of about 40° between ladder-leg sections, or a straight-ladder position to establish an angle of about 180° between ladder-leg sections.

Figure 5:
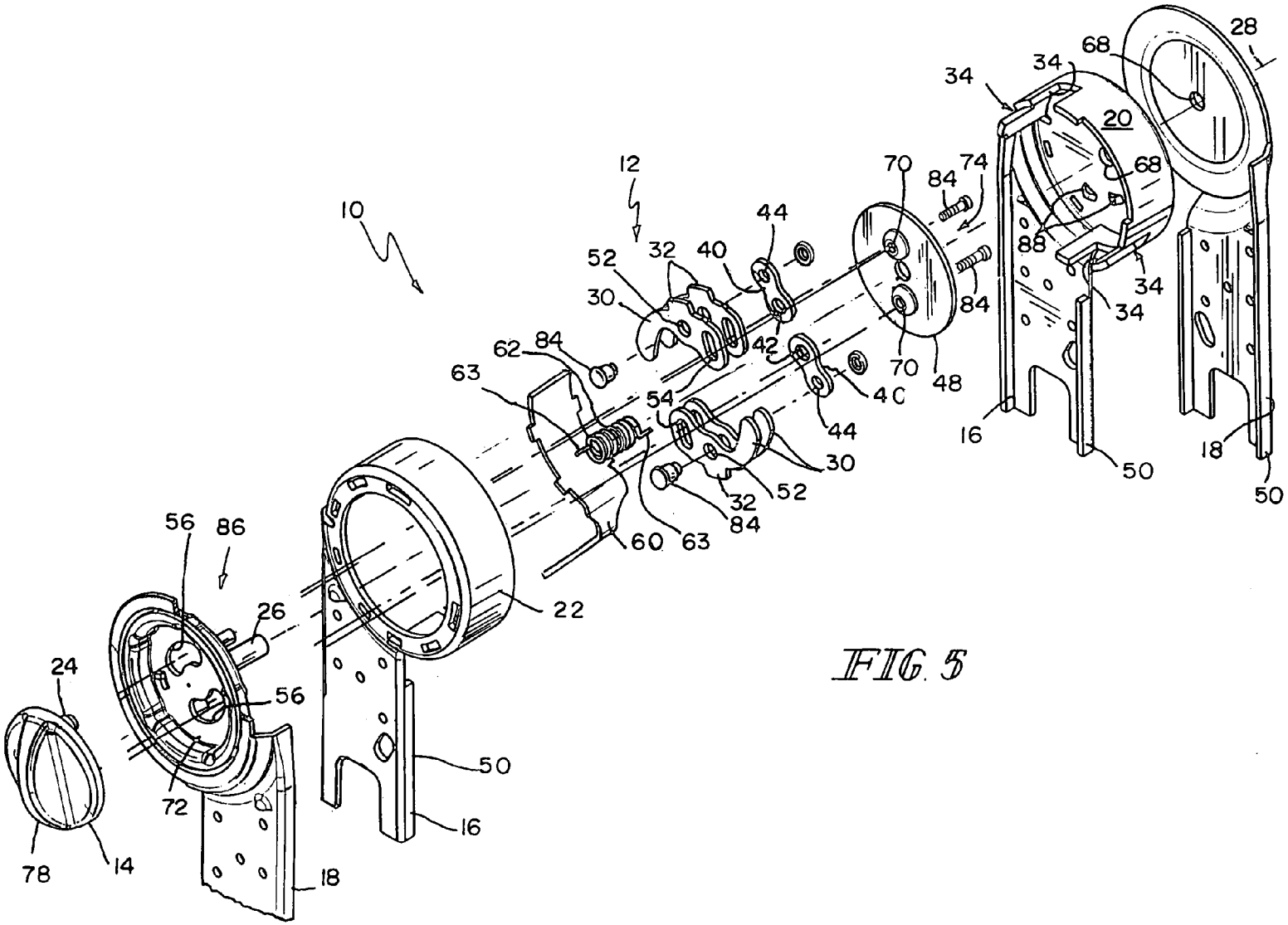
FIG. 5 is an exploded perspective view of the lockable ladder hinge of FIG. 4 showing (from left to right) an actuator, a front portion of a second hinge member, a front portion of a first hinge member, a lock, a rear portion of the first hinge member, and a rear portion of the second hinge member.

First hinge member 16 includes a cylindrical inner housing 20 and a cylindrical outer housing 22, as shown best in FIG. 5. First hinge member 16 is coupled to second hinge member 18 for rotation about a common axis 28. Cylindrical inner housing 20 includes an annular flange portion 38 coupled to a side wall 46 and an attachment arm portion 50. Annular flange portion 38 is formed to include a plurality of tab-receiving spaces 34. Side wall 46 is formed to include a common axis bore 68 formed to receive an axis shaft 26 coupled to an inner surface 86 of second hinge member 18. Cylindrical inner housing 20 is arranged to nest within cylindrical outer housing 22 such that both housings are concentric to common axis 28.

Second hinge member 18 includes an actuator receiver 72, axis shaft 26, and attachment arm portion 50, as shown, for example, in FIG. 5. Actuator receiver 72 is formed to include a pair of arcuately-shaped oblong apertures 56 arranged to receive a pair of connector posts 24 coupled to actuator 14.

Figure 4:
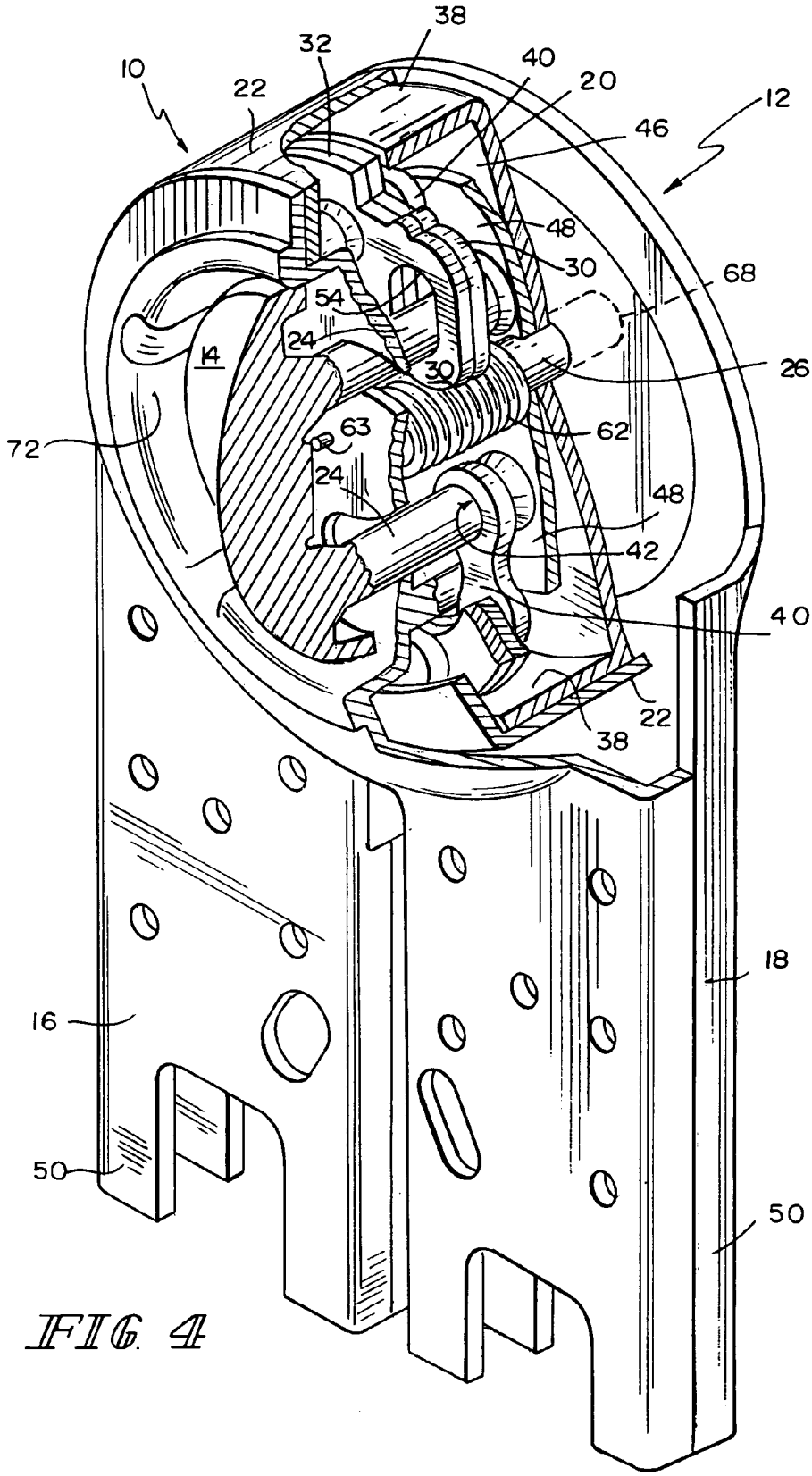
FIG. 4 is an enlarged perspective view shown in FIG. 1, with portions broken away, of the lockable ladder hinge showing components included in the hinge.

Actuator 14 includes a finger-receiving flange portion 78 and a pair of connector posts 24 cantilevered to an inner surface 80 of actuator 14, as shown in FIGS. 4 and 5. In the illustrative embodiment, actuator 14 is an annular knob 14 arranged for rotary movement about common axis 28.

Lock 12 is coupled to second hinge member 18 and includes a pair of cams 30, a pair of links 40, a mounting plate 48, a spring 62, and a fastener 86, as shown best in FIG. 5. Each cam 30 and each link 40 is similar to one another in structure and function so that the description of one cam 30 and one link 40 applies to the other cam 30 and link 40 as well.

Cam 30 is formed to include an annular aperture 52 and an oblong aperture 54, as shown in FIGS. 4 and 5. Cam 30 further includes a tab 32 formed on a perimeter edge of cam 30. Tab 32 is arranged to be received by tab-receiving spaces 34 formed in annular flange 38 upon movement of cam 30 radially outwardly from common axis 28. The illustrated cam 30 is configured as a pair of generally flat plates abutting or confronting one another to form a single unit. Mounting plate 48 is formed to include common axis bore 68, a spring-retainer aperture 82, and a pair of spaced-apart apertures 70 arranged to receive connector posts 24.

Figure 6:
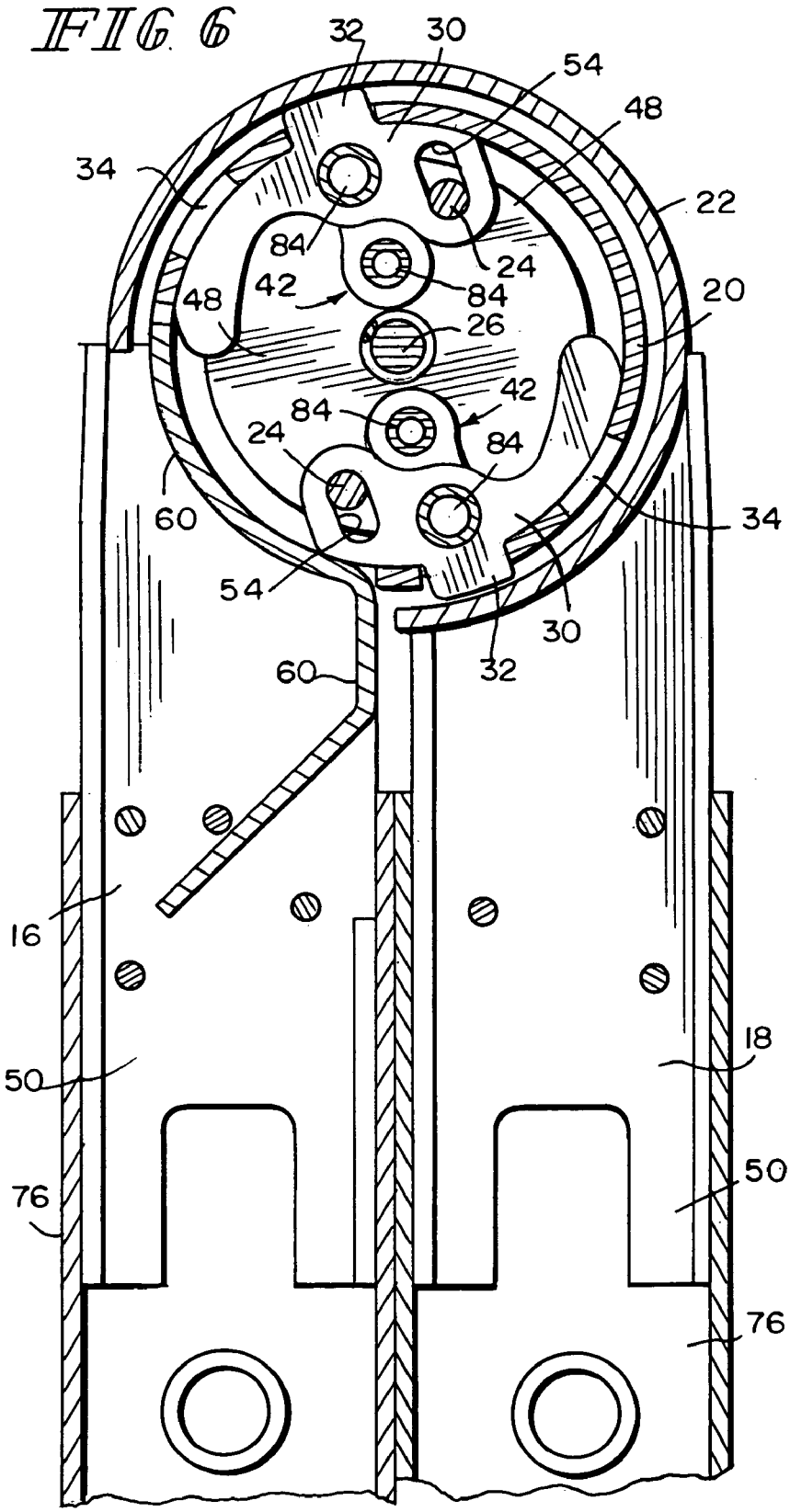
FIGS. 6–9 show movement of components included in the lockable ladder hinge of FIG. 1 as the hinge is moved from the closed-ladder (0°) position shown in FIG. 1 toward the trestle-ladder (40°) position shown in FIG. 2.

Referring now to FIG. 6, link 40 is formed to include a distal aperture 42 and a proximal aperture 44. Fastener 86 extends through annular aperture 52 of cam 30 and distal aperture 42 of link 40 to couple link 40 to cam 30 for pivotable movement relative to one another.

Each connector post 24 extends through knob receiver apertures 56, oblong aperture 54, and proximal aperture 44 and is coupled to mounting plate 48 for pivotable movement of knob 14 and mounting plate 48 about common axis 28, as shown best in FIGS. 4 and 5. Knob 14, connector post 24, and mounting plate 48 thus provide means for coupling knob 14 to cam 30 so that, when knob 14 is moved in a first direction, cam 30 moves radially outwardly relative to common axis 28 to cause tab 32 to enter tab-receiving space 34 to block pivotable movement of first hinge member 16 relative to second hinge member 18. When knob 14 is moved in a second direction, cam 30 moves radially inwardly relative to common axis 28 to cause tab 32 to withdraw from tab-receiving space 34 to allow pivotable movement of first hinge member 16 relative to second hinge member 18.

The illustrated spring 62 is configured as a helical spring, as shown in FIG. 5. Spring 62 includes end portions 63 arranged to be received by spring-retainer apertures 82 formed in mounting plate 48 and in actuator receiver 72. Referring now to FIG. 4, axis shaft 26 is arranged to extend from interior surface 86 of actuator receiver 72 through a middle portion of spring 62 through the common axis bore 68 formed in mounting plate 48, side wall 46, and second hinge member 18.

Figure 9:
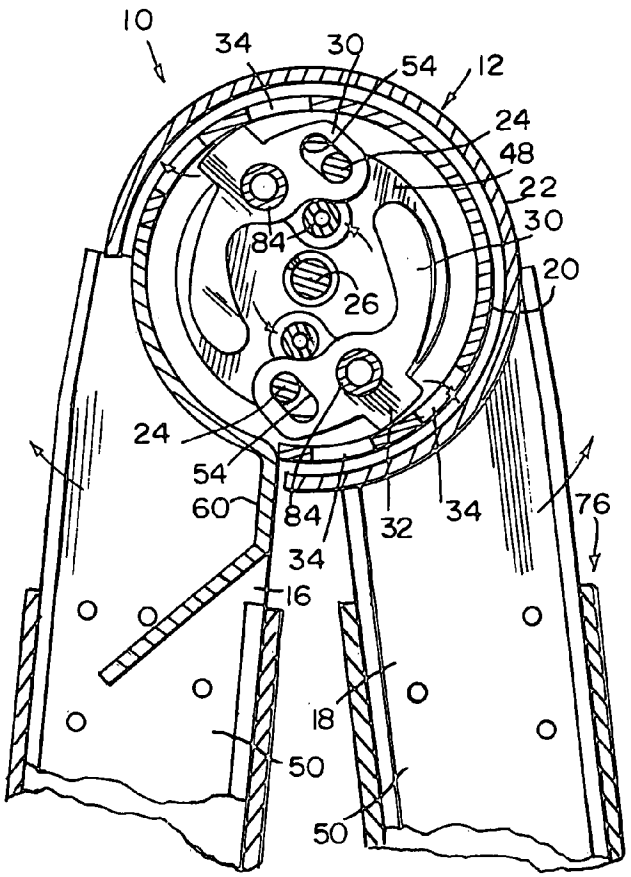

Spring 62 is further arranged to urge mounting plate 48 to rotate to cause cam 30 to extend radially outwardly from common axis 28 against annular flange portion 38, as shown, for example, in FIG. 9. Upon rotative movement of first and second hinge members 16, 18 about common axis 28, tab-receiving spaces 34 align with and are able to receive tab 32. Referring now to FIG. 6, upon movement of tab 32 into tab-receiving space 34, movement of first hinge member 16 and second hinge member 18 is blocked. Each tab receiving space 34 is associated with one of the locked positions of hinge 10 to allow ladder-leg sections 76 to be arranged in the closed, trestle-ladder, or straight-ladder positions.

Lockable hinge 10 further includes a diverter 60 coupled to side wall 46, as shown best in FIG. 6. Diverter 60 is arranged to form an arcuate section of annular flange portion 38. Diverter 60 is arranged to permit expulsion of any dirt or foreign matter which may accumulate within lock 12.

A plurality of retainer ridges 88 are formed on side wall 46, as shown in FIG. 5. Retainer ridges 88 cooperate with similar mounting plate retainer ridges 74 formed on a facing surface of mounting plate 48 to retain lock 12 momentarily in the unlocked position upon user input to move knob 14 from the first position to the second position where tab 30 moves toward common axis 28 to cause tab 32 to withdraw from tab-receiving space 34. Thus, retainer ridges 74 and 88 cooperate to provide means for allowing a user to unlock the hinges so that ladder-leg sections 76 can be moved to a desired predetermined position.

Upon pivoting movement of ladder-leg sections 76, first hinge member 16 rotates to cause retainer ridges 74 and retainer ridges 88 to disengage and cam 30 to be urged against annular flange portion 38 until tab 32 is again able to align with one of tab-receiving spaces 34 and move radially outwardly from common axis 28 to enter tab-receiving space 34.

Figure 8:
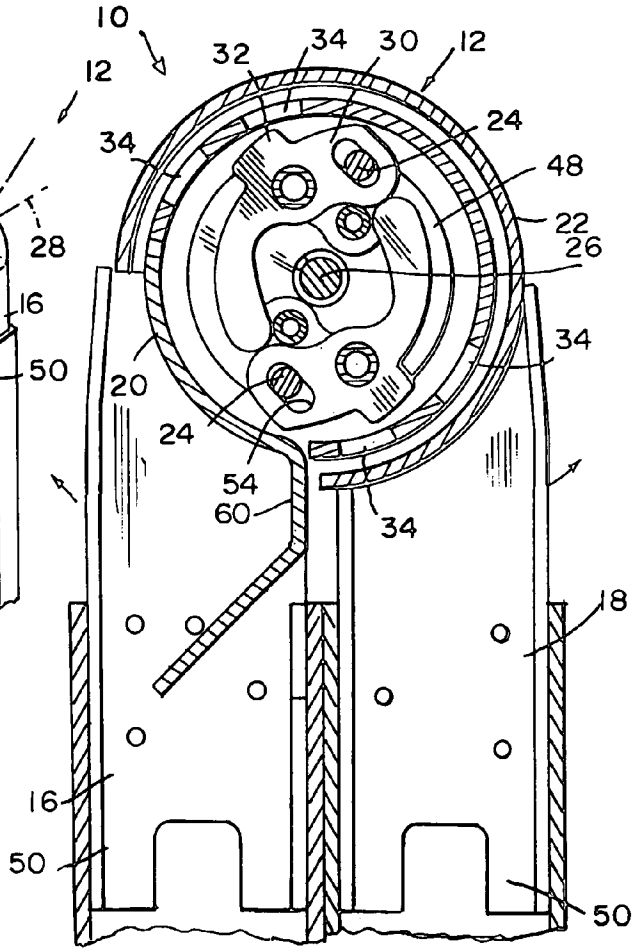
Figure 7:
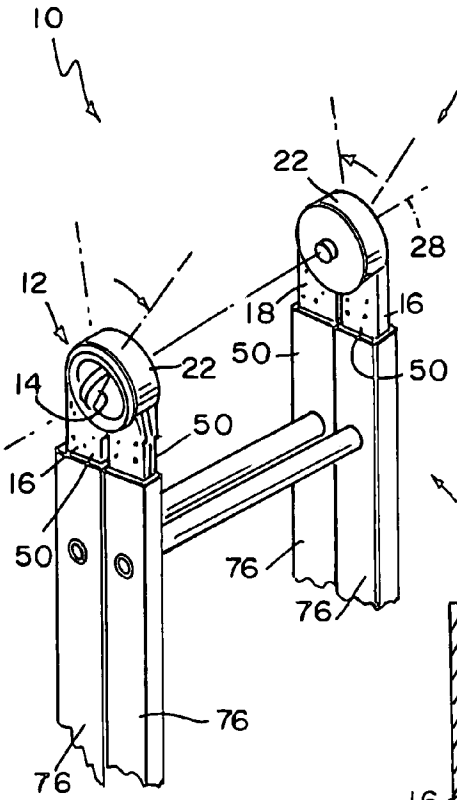
Figure 10:
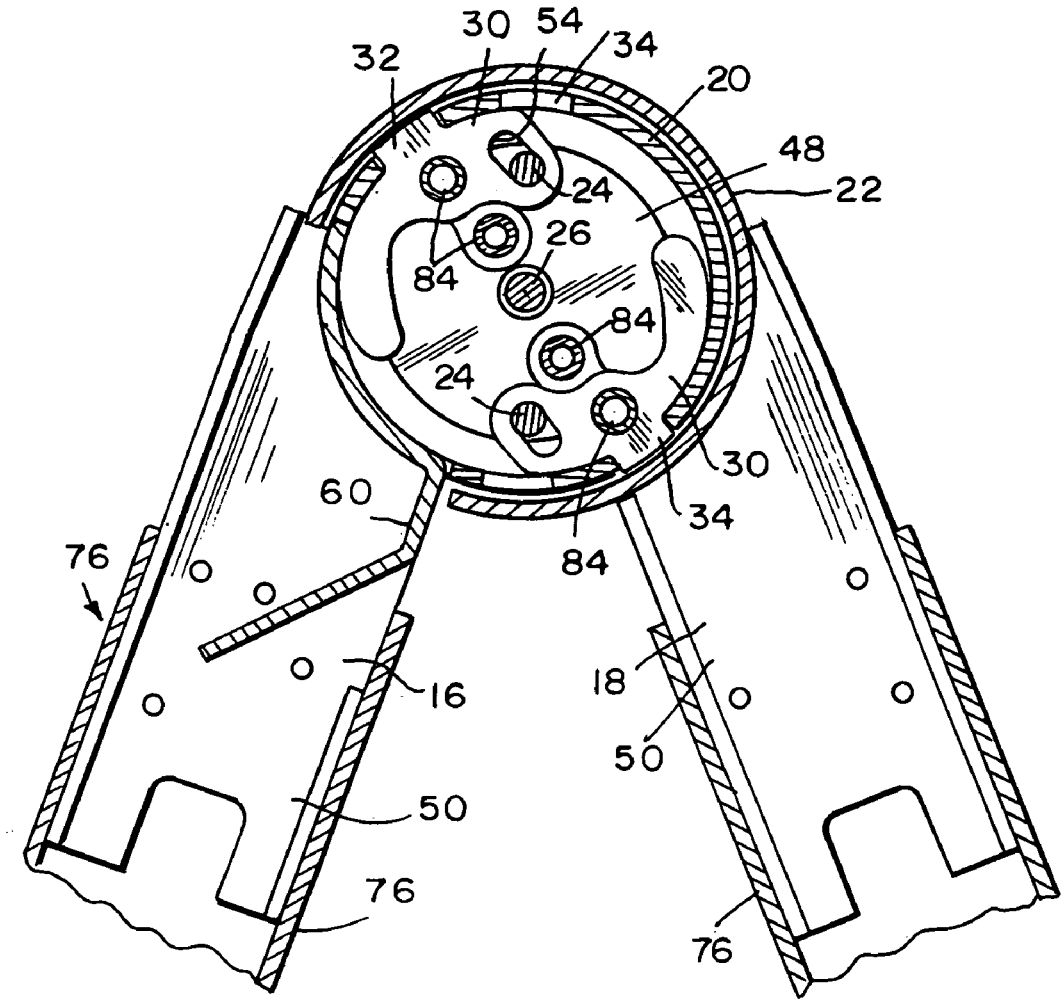
FIGS. 10–13 show movement of components included in the lockable ladder hinge of FIG. 2 as the hinge is moved from the trestle-ladder (40°) position shown in FIG. 2 toward the straight-ladder (180°) position shown in FIG. 3.
Figures 11, 12, 13:
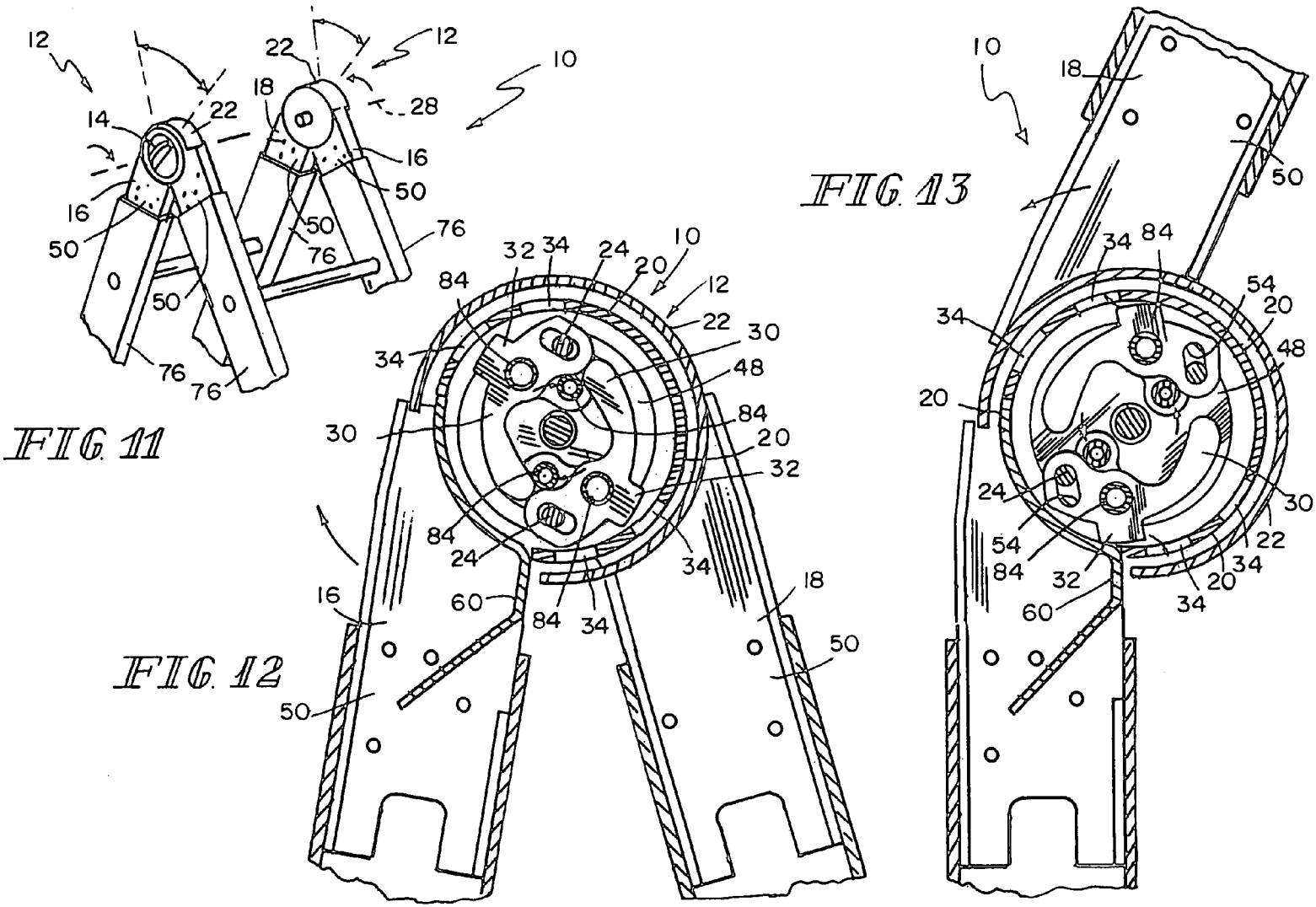

To move ladder-leg sections 76 from the closed position shown in FIG. 7, to the trestle-ladder position, shown in FIGS. 2, 10, and 11, knob 14 is rotated from the first position to the second position, as suggested in FIG. 7. Referring now to FIG. 8, upon rotation of knob 14, mounting plate 48 rotates to cause cam 30 to move radially inwardly toward common axis 28 wherein tab 32 withdraws from tab-receiving space 34. When knob 14 is rotated to the second position, mounting plate retainer ridges 74 engage and cooperate with retainer ridges 88 to retain knob 14 momentarily in the second position and retain cam 30 in a retracted position, closer to common axis 28. When lock 12 is retained momentarily in the second position, first and second hinge members 16 and 18 are free to pivot relative to one another, and thus a user is able to move ladder-leg sections 76 to the trestle-ladder position, as suggested in FIGS. 8–10.

Figure 14:
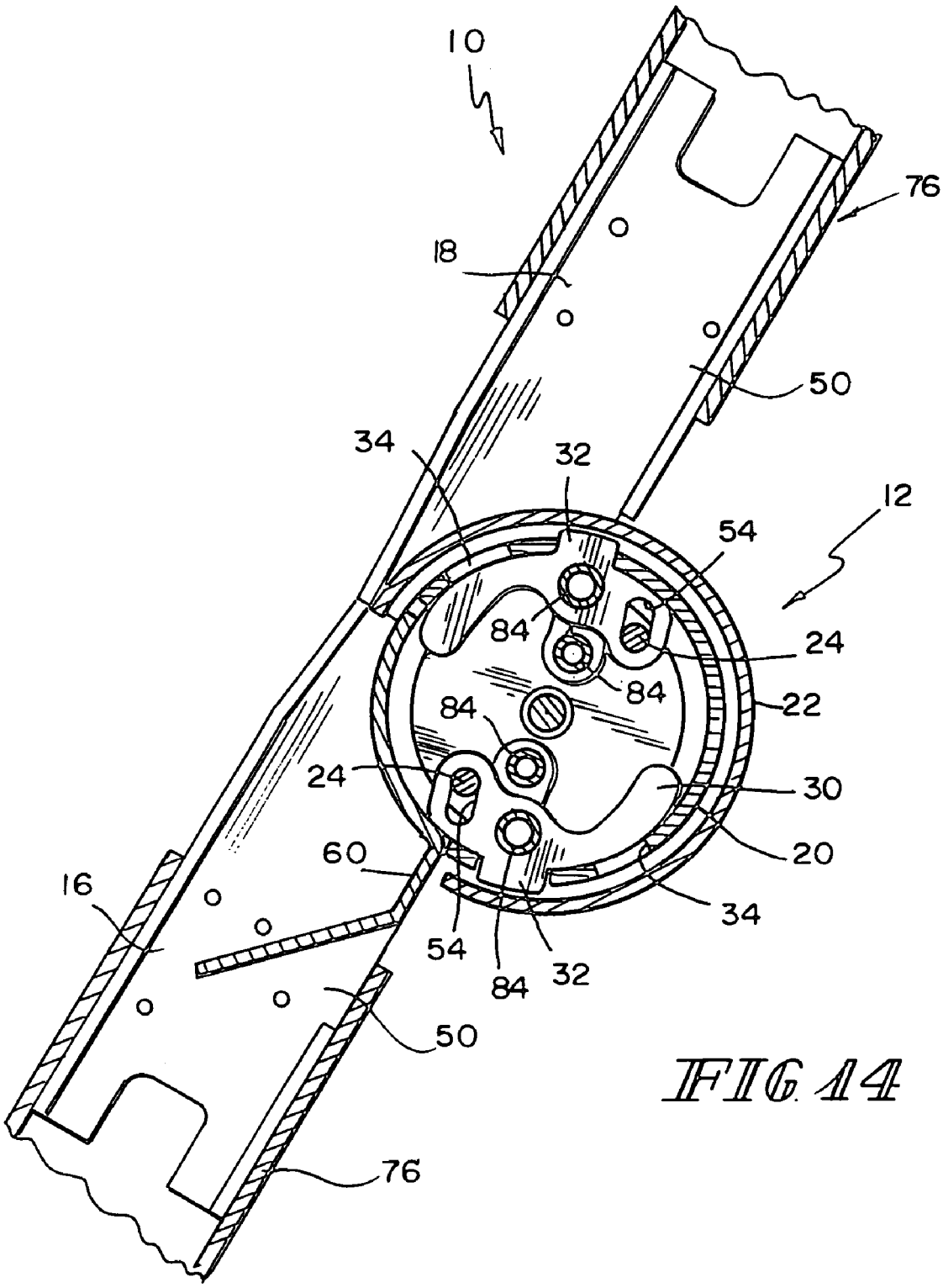
FIG. 14 is an enlarged side elevation view of the lockable ladder hinge of FIG. 3, with portions broken away, showing the hinge locked in the straight-ladder (180°) position.

To move ladder-leg sections 76 from the trestle-ladder position shown in FIGS. 2, 10, and 11, to the straight-ladder position, shown in FIGS. 3 and 14, knob 14 is rotated from the first position to the second position, as suggested in FIG. 11. Referring now to FIG. 12, upon rotation of knob 14, mounting plate 48 rotates to cause cam 30 to move radially inwardly toward common axis 28 wherein tab 32 withdraws from tab-receiving space 34. When knob 14 is rotated to the second position, mounting plate retainer ridges 74 engage and cooperate with retainer ridges 88 to retain knob 14 momentarily in the second position and retain cam 30 in a retracted position, closer to common axis 28. When lock 12 is retained momentarily in the second position, first and second hinge members 16 and 18 are free to pivot relative to one another, and thus a user is able to move ladder-leg sections 76 to the straight-ladder position, as suggested in FIGS. 12–14.

With respect to lockable hinge 10, knob 14, connector post 24, and mounting plate 48 cooperate to provide means for coupling knob 14 to cam 30 so that, when knob 14 is moved in a first direction, cam 30 moves radially outwardly relative to common axis 28 to cause tab 32 to enter tab-receiving space 34 to block pivotable movement of first hinge member 16 relative to second hinge member 18. Lockable hinge 10, knob 14, connector post 24, and mounting plate 48 also cooperate to provide means for coupling knob 14 to cam 30 so that, when knob 14 is moved in a second direction, cam 30 moves radially inwardly relative to common axis 28 to cause tab 32 to withdraw from tab-receiving space 34 to allow pivotable movement of first hinge member 16 relative to second hinge member 18.

The invention claimed is:

1. A lockable hinge comprising first and second hinge members coupled together for rotation about a common axis, a lock coupled to the second hinge member, the first hinge member being formed to include a lock-receiving space, a knob having a connector post coupled to the lock and arranged for movement in a first direction about the common axis wherein the lock is arranged for radial movement away from the common axis and wherein a portion of the lock is received in the lock-receiving space to block movement of the first and second hinge members relative to one another about the common axis, and wherein the knob is further arranged for movement in a second direction about the common axis wherein the lock is arranged for radial movement toward the common axis and wherein the lock portion withdraws from the lock-receiving space to allow movement of the first and second hinge members relative to one another about the common axis, wherein the lock includes a mounting plate coupled to the knob for rotation therewith about the common axis, and a cam having the tab coupled to the mounting plate wherein, when the knob is rotated in the first direction, the cam moves radially outwardly relative to the common axis to cause the tab to enter the lock-receiving space to lock the hinge members, and wherein, when the knob is rotated in the second direction, the cam moves radially inwardly relative to the common axis to cause the tab to withdraw from the lock-receiving space to unlock the hinge members, and wherein the mounting plate is formed to include a pair of mounting apertures and a central axis bore coupled to a pair of generally L-shaped cams formed to include an annular aperture and an oblong aperture, a pair of links formed to include a distal aperture and a proximal aperture, and a helical spring.

2. The hinge of claim 1, wherein the lock includes an outwardly-extending tab and the first hinge member includes a tab-receiving space arranged wherein the tab enters the tab-receiving space to lock the hinge members and the tab is withdrawn from the tab-receiving space to unlock the hinge members in response to the rotation of the knob.

3. The hinge of claim 2, wherein the tab and the tab-receiving space extend radially relative to the common axis.

4. The hinge of claim 1, wherein the knob is formed to include a pair of connector posts coupled to the mounting plate through the oblong cam apertures and the proximal link apertures.

5. The hinge of claim 4, wherein the second hinge member includes an axis shaft arranged to rotate about the common axis and extending through a central bore formed in the mounting plate and an inner housing of the first hinge member and the axis shaft is arranged coaxially through the helical spring to bias the mounting plate to cause each cam to extend radially outwardly against the annular flange portion of the inner housing upon movement of the knob in the first direction.

6. The hinge of claim 2, wherein the first hinge member includes a cylindrical inner housing having an annular flange portion and the tab-receiving space is formed in the annular flange portion.

7. The hinge of claim 6, wherein the annular flange portion of the inner housing of the first hinge member is formed to include a plurality of tab-receiving spaces corresponding to a closed position, a trestle-ladder position, and a straight-ladder position of the hinge members.

8. The hinge of claim 6, wherein the lock is arranged to be received in the inner housing of the first hinge member.

9. The hinge of claim 6, wherein the first hinge member includes a cylindrical outer housing arranged to nest around the cylindrical inner housing and the two housings are arranged to lie in concentric relation to the common axis.

10. The hinge of claim 9, wherein the inner and outer housings are arranged for rotative movement relative to one another about the common axis.

11. A lockable hinge comprising first and second hinge members coupled together for rotation about a common axis, a cam having a tab coupled to the second hinge member, the first hinge member having a tab-receiving space, an actuator, means for coupling the actuator to the cam so that, when the actuator is moved in a first direction, the cam moves radially outwardly relative to the common axis to cause the tab to enter the tab-receiving space to lock the hinge members, and so that, when the actuator is moved in a second direction, the cam moves radially inwardly relative to the common axis to cause the tab to withdraw from the tab-receiving space to unlock the hinge members, and wherein the means for coupling the actuator to the cam further includes a link having one end pivotably coupled to the mounting plate and a second end pivotably coupled to the cam.

12. The hinge of claim 11, wherein the means for coupling the actuator to the cam includes a knob having a pair of connector posts and a mounting plate, the connector posts are coupled to the mounting plate therewith for rotation about the common axis, and the cam is coupled to the mounting plate and arranged for movement of the knob in the first direction wherein the cam moves radially outwardly relative to the common axis to cause the tab to enter the tab-receiving space to lock the hinge members, and further arranged for movement of the knob in a second direction wherein the cam moves radially inwardly relative to the common axis to cause the tab to withdraw from the tab-receiving space to unlock the hinge members.

13. The hinge of claim 11, wherein the means for coupling the actuator to the cam further includes two cams and two links.

14. The hinge of claim 11 wherein the means for coupling the actuator to the cam includes a knob having a connector post and a mounting plate, the connector post is coupled through the cam to the mounting plate to rotate in a first direction about the common axis, the tab being arranged for radial movement away from the common axis into the tab-receiving space to block the second hinge member from pivoting relative to the first hinge member, and to rotate in a second direction about the common axis wherein the tab is arranged for radial movement toward the common axis to withdraw the tab from the tab-receiving space to allow the second hinge member to pivot relative to the first hinge member.

15. The hinge of claim 14, wherein the first hinge member includes a cylindrical outer housing and a cylindrical inner housing having an annular flange portion formed to include the tab-receiving space, the inner housing is arranged to nest within the outer housing, and the two housings are arranged to lie in concentric relation to the common axis.

16. The hinge of claim 15, wherein the annular flange portion of the inner housing is formed to include a plurality of tab-receiving spaces to lock the hinge members among a closed position, a trestle-ladder position, and a straight-ladder position.

17. The hinge of claim 15, wherein the inner and outer housings are arranged to rotate about the common axis.

18. The hinge of claim 14, wherein the knob, connector post, cam, tab, mounting plate, and tab-receiving space cooperate to comprise a lock.

19. The hinge of claim 18, wherein the lock is arranged to nest within the cylindrical inner housing of the first hinge member.

* * * * *